US005915854A

United States Patent [19]

Burke et al.

[11] Patent Number: 5,915,854

[45] Date of Patent: Jun. 29, 1999

[54] DIET OR MEDICINE MANAGEMENT DEVICE

[76] Inventors: Pennie L Burke; Henry H Burke, both of 1122 Palisades Cir., Columbia, S.C. 29223

[21] Appl. No.: 08/839,099

[22] Filed: Apr. 23, 1997

Related U.S. Application Data

[63] Continuation-in-part of application No. 08/762,209, Dec. 9, 1996, abandoned.

[51] Int. Cl.[6] ..... G09F 11/00

[52] U.S. Cl. ..... 40/491; 40/600; 116/323

[58] Field of Search ..... 40/490, 491, 600, 40/618, 620; 434/127, 203; 116/321, 323, 324; 283/115, 900

[56] References Cited

U.S. PATENT DOCUMENTS

| | | | |
|---|---|---|---|
| 1,501,233 | 7/1924 | Rand | 40/491 X |
| 1,880,089 | 9/1932 | Heidecorn et al. | 116/323 |
| 3,419,979 | 1/1969 | McVicker et al. | 116/324 X |
| 3,522,666 | 8/1970 | Sarthou | 116/323 X |
| 3,841,260 | 10/1974 | Sharp et al. . | |
| 4,335,300 | 6/1982 | Shepherd | 235/123 |
| 4,625,675 | 12/1986 | Rosenberg . | |
| 4,652,241 | 3/1987 | McCarty . | |
| 4,832,603 | 5/1989 | Basil . | |
| 4,976,622 | 12/1990 | Clark . | |
| 5,331,919 | 7/1994 | Root et al. | 116/323 |
| 5,342,665 | 8/1994 | Krawitz | 40/600 X |
| 5,382,165 | 1/1995 | Knox . | |

*Primary Examiner*—Brian K. Green
*Attorney, Agent, or Firm*—Michael A Mann; Nexsen Pruet Jacobs & Pollard LLP

[57] ABSTRACT

A device for managing a diet or the consumption of medication comprises a board formed with a plurality of horizontal cut-out portions which define a plurality of horizontal guide rails therebetween. A plurality of slide members are removably received by the guide rails and slide thereon. A legend, attached to the front face of the board, identifies the major food groups and contains examples of foods falling within each food group and serving suggestions that constitute a single portion of the particular food group. When an individual consumes a food, a slide member from that food group is moved from the right to the left hand side of the guide rail to indicate consumption. Alternatively, the legend contains a list of medicines to be consumed by an individual, their dosages and frequency of administration. When a particular medicine is consumed, a slide member is moved from the right to left hand side of the guide rail to indicate consumption. A series of magnets extends from the rear face of the board, allowing attachment to a magnetic surface.

20 Claims, 2 Drawing Sheets

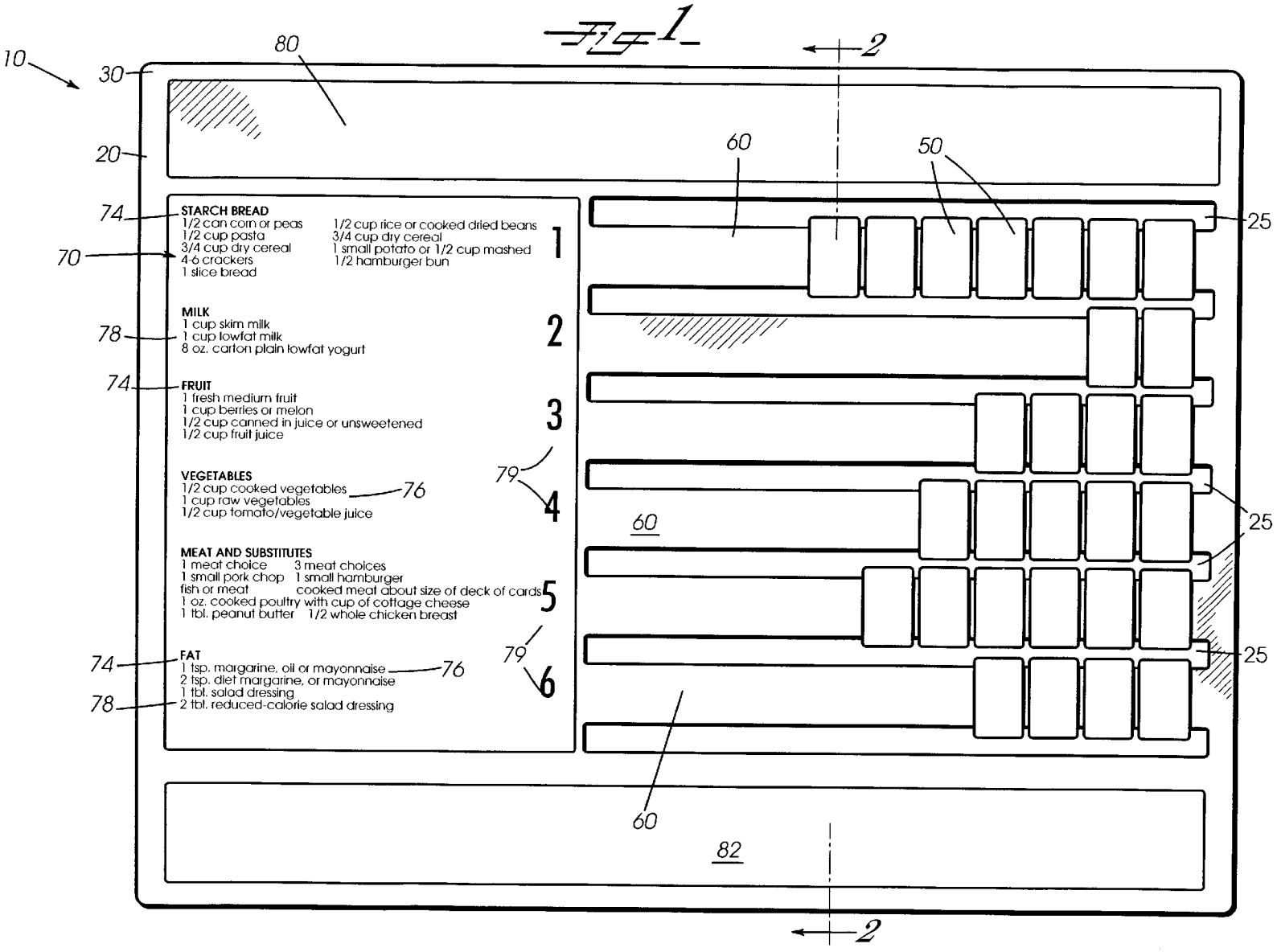
Fig. 1
STARCH BREAD
1/2 can corn or peas
1/2 cup pasta
3/4 cup dry cereal
4-6 crackers
1 slice bread
1/2 cup rice or cooked dried beans
3/4 cup dry cereal
1 small potato or 1/2 cup mashed
1/2 hamburger bun
MILK
1 cup skim milk
1 cup lowfat milk
8 oz. carton plain lowfat yogurt
FRUIT
1 fresh medium fruit
1 cup berries or melon
1/2 cup canned in juice or unsweetened
1/2 cup fruit juice
VEGETABLES
1/2 cup cooked vegetables
1 cup raw vegetables
1/2 cup tomato/vegetable juice
MEAT AND SUBSTITUTES
1 meat choice
3 meat choices
1 small pork chop
1 small hamburger
fish or meat
cooked meat about size of deck of cards
1 oz. cooked poultry with cup of cottage cheese
1 tbl. peanut butter
1/2 whole chicken breast
FAT
1 tsp. margarine, oil or mayonnaise
2 tsp. diet margarine, or mayonnaise
1 tbl. salad dressing
2 tbl. reduced-calorie salad dressing
1
2
3
4
5
6
10
20
25
30
50
60
70
74
76
78
79
80
82
2

DIET OR MEDICINE MANAGEMENT DEVICE

This application is a continuation-in-part of application Ser. No. 08/762,209 filed Dec. 9, 1996, now abandoned.

BACKGROUND OF THE INVENTION

1. Field of the Invention

The present invention relates generally to a device for use in helping an individual keep track of foods consumed, medication taken, or the like. More specifically, the present invention provides an easy-to-use kit for monitoring the foods or medicines consumed within a particular time period.

2. Discussion of Background

Many individuals attempt to maintain a balanced diet. The reasons for doing so vary with the individual. Some individuals diet in order to maintain a healthy lifestyle, while others do so because of medical necessity, especially diabetics and persons suffering from medical obesity.

The majority of diets are based on a preselected number of calories that an individual may consume during a day. The total caloric intake is then divided among the major food groups in order to arrive at the number of portions of each food group that an individual may consume. The importance of dividing the caloric intake among the food groups cannot be overstated, because this assures that the individual will consume the proper amount of vitamins and minerals.

One problem associated with dieting is the difficulty in remembering what is consumed during the course of the day. Still another problem with dieting is planning one's meals and snacks. Both of these problems stem from the lack of a device that enables a dieter to record what has been eaten and to quickly identify the food choices remaining so that one's meals can be planned accordingly.

Another problem faced by many individuals, including the elderly, is the management of a series of prescribed medications. Often these individuals do not take these medicines in accordance with the doctor's prescription simply because they forget to. In other circumstances an individual may consume more than the prescribed dosage because they do not remember taking the medication earlier. Failure to follow the prescribed dosage of a series of medications is extremely dangerous and often leads to injury or death.

Therefore, there exists a need for a management device for managing a diet or a series of medications which enables a person to quickly identify the foods or medications which have been taken, and which also identifies the foods or medicines that remain to be consumed.

SUMMARY OF THE INVENTION

According to its major aspects and briefly stated, the present invention is a diet and/or medicine management device that enables an individual to keep track of particular foods or medicines consumed in a particular time period. The device is in the form of a kit which comprises a board manufactured with a plurality of horizontal cut-out portions formed therein, which define a plurality of guide rails therebetween, a plurality of slide blocks dimensioned to be received by the guide rails and moved horizontally therealong, a legend identifying the food groups and examples of foods that qualify as a single serving of a particular food group or the medicines required for a particular individual, and a series of magnets which are adhesively attached to the rear surface of the board, enabling the removable attachment of the device to a steel or iron surface.

The legend is arranged so that each guide rail and the corresponding slide members are dedicated to a particular food group. Positioned within each guide rail is a specific number of slide blocks that represent the total number of servings of a particular food group that an individual may consume during a particular interval of time. In an alternative preferred embodiment, the legend identifies particular medicines while the assigned slide blocks represent the total number of times the medicine must be taken in a time interval.

A major feature of the present invention is the combination of the legend and the removable slide blocks. When a person consumes a serving of a particular food or a dosage of medicine, a slide block corresponding to that food group or medicine is moved along the guide rail from right to left. The slide blocks remaining on the right indicate the number of servings or dosages that an individual may still consume. This provides a simple and effective method of managing one's consumption during a particular period of time. Moreover, if there are modifications to the diet or drug regime, slide blocks can be added or removed from the particular guide rail to incorporate the changes.

Still another feature of the present invention is the use of magnetic strips attached to the rear face of the board. These strips allow the device to be removably attached to a magnetic surface, especially a refrigerator. Placing the device on the refrigerator provides a visual reminder to individuals and increases the probability that the device will be used regularly.

Other features and advantages will be apparent to those skilled in the art from a careful reading of the detailed description of a preferred embodiment accompanied by the following drawings.

BRIEF DESCRIPTION OF THE DRAWINGS

In the drawings,

FIG. 1 is a front view of a diet management device according to a preferred embodiment of the present invention;

DETAILED DESCRIPTION OF A PREFERRED EMBODIMENT

Figure 2:
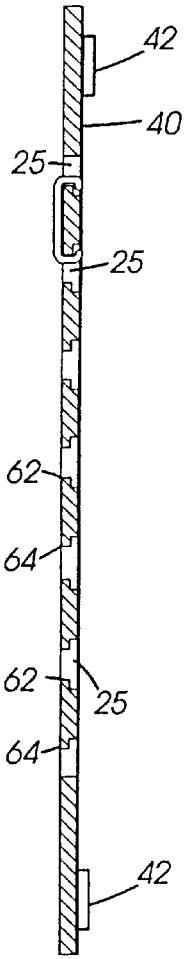
FIG. 2 is a cross-sectional side view of a diet management device according to a preferred embodiment of the present invention taken along line 2—2 of FIG. 1.

The present invention is a device for use in managing a diet or a series of medicines. More specifically, the present invention provides a diet or medicine management kit which indicates the consumption of a particular type of food or medicine. Referring now to FIGS. 1 and 2, there is shown a front view and a side view, respectively, of a device according to a preferred embodiment of the present invention and generally designated by reference numeral 10. Device 10 comprises a board 20 having a front face 30, a rear face 40, and a plurality of slide members 50. Preferably, there are forty slide members 50.

Board 20 is formed having a plurality of horizontal cut-out portions 25 which define a series of guide rails 60 therebetween (best illustrated in FIG. 2). Each guide rail 60 has an upper lip 62 and a lower lip 64 extending rearwardly from front face 30 a preselected distance toward rear face 40. Board 20 may be manufactured to contain any number of guide rails 60. Preferably, there are six guide rails 60. The side profile of slide members 50 is a C-shape, allowing slide members 50 to be removably received by upper lips 62 and lower lips 64 of guide rails 60 and to slide horizontally therealong. Positioned adjacent to guide rails 60 is a legend 70. Preferably, legend 70 is a thin, flexible sheet of material attached to front face 30 of board 20 using any adhesive commonly employed in the art. Alternatively, legend 70 may be painted or printed onto face 30; however, legend 70 is preferably a pre-cut, pre-printed, peal-and-stick vinyl tab. Legend 70 carries information that is divided into major food groups 74. Below each food group 74 are examples of particular foods 76, each of which comes with a serving suggestion 78 that constitutes a single serving of the particular food group to which it belongs. Each food group 74 represented on legend 70 is positioned directly adjacent to a guide rail 60. Legend 70 further contains a series of numbers 79 which define a correspondence between a food group 74 and the adjacent guide rail 60.

Board 20 may contain additional legends 80 and 82. Legend 80 may contain advertising, while legend 82 may have the name of the individual whose diet is being managed. Attached to rear face 40 of board 20 are magnets 42 which enable the removable attachment of device 10 to a magnetic-holding surface, preferably a refrigerator.

In use, device 10 is set up according to a specific diet having a minimum caloric intake divided into the number of serving portions of each food group that may be consumed in a specified period of time, normally twenty-four hours. For example, an 1800 calorie diet may allow the consumption of seven servings of a starch or bread, two servings of a milk or dairy product, four servings of fruit, five servings of vegetables, six servings of meat or poultry, and four servings of fat. The corresponding number of slide members 50 are then inserted in the guide rail 60 corresponding to the particular food group. Using the example above, four slide members 50 would be placed in guide rail 60 adjacent to the starch/bread food group.

When a person consumes a food serving from a particular food group, a slide member 50 dedicated to that food group is moved to the left hand side of guide rail 60. Thus, for any particular diet an individual will know what has been consumed and what food choices remain. When the specified time period has transpired, device 10 is reset by moving all slide members 50 to the right hand side of guide rails 60.

Figure 3:
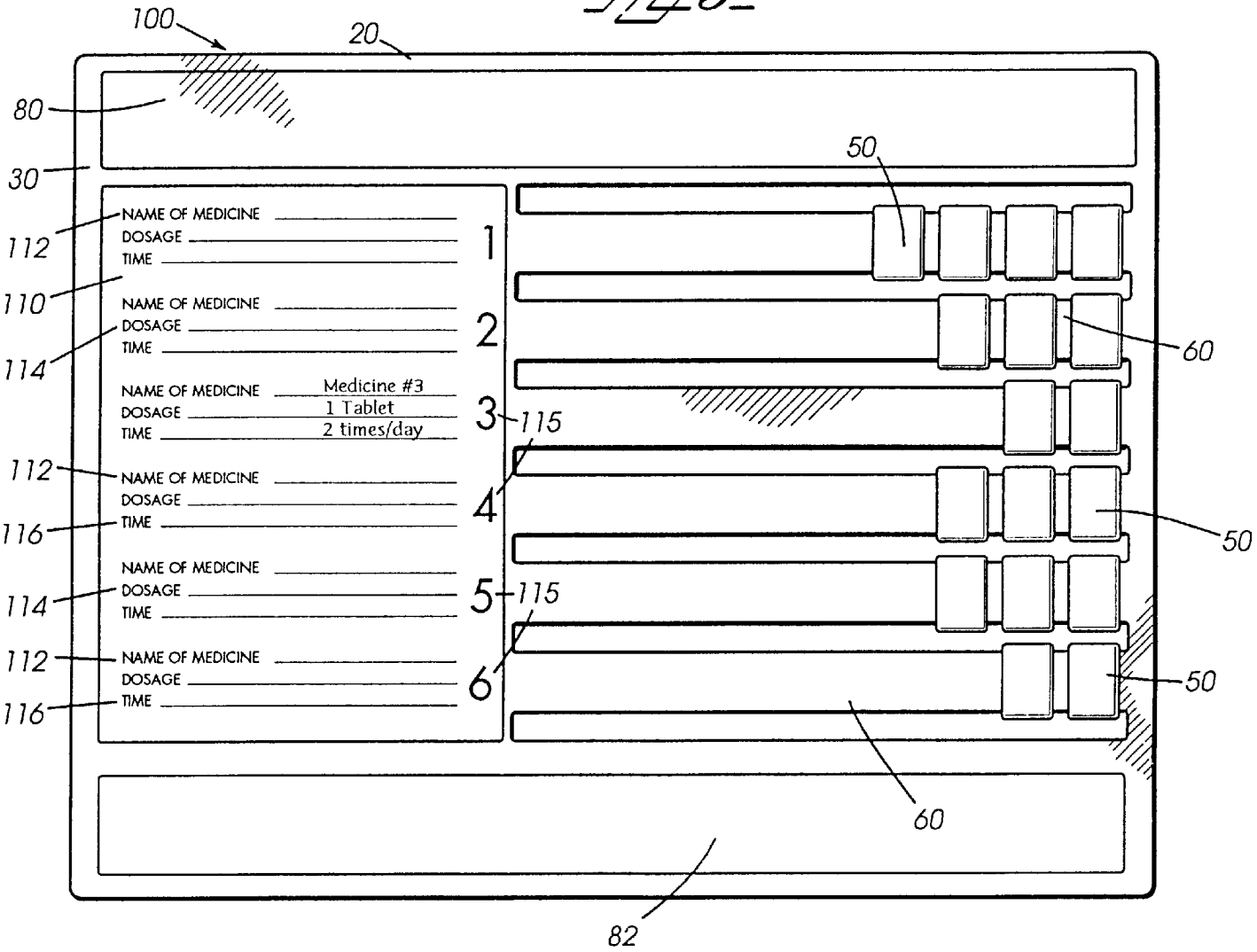
FIG. 3 is a front view of a medicine management device according to an alternative preferred embodiment of the present invention.

Turning now to FIG. 3, there is shown a front view of a device for managing the consumption of medicines, according to an alternative preferred embodiment and generally designated by reference numeral 100. In this embodiment, a legend 110 is secured to front face 30 of board 20, adjacent to guide rails 60. Legend 120 contains a listing of medicines 112 that an individual is required to take. Below each medicine 112 is placed a dosage amount 114 and a frequency of administration 116. Each medicine 112 represented on legend 110 is positioned directly adjacent to a guide rail 60. Legend 110 further contains a series of numbers 115 which define a correspondence between a medicine 112 and the adjacent guide rail 60.

In use, legend 110 is affixed to device 100. Thereafter, the names of the medicines 112 are written in the appropriate spaces as well as the dosage amount 214 and the frequency of administration 116. Thereafter, a quantity of slide members 50 corresponding to the frequency of administration 116, would be placed in the guide rail 60 adjacent to each particular medicine 112. In this embodiment, there are preferably twenty slide members 50. Thus, for example, as illustrated in FIG. 3, the guide rail 60 adjacent to the medicine 112 labeled "medicine #3" would be assigned two slide members 50. When a person consumes a certain dosage of medicine, a slide member 50 located on the guide rail 60 adjacent to the appropriate medicine is moved to the left hand side of board 20. Thus, for any particular regime of medications, an individual will know what has been consumed and what medicines remain to be taken. When the specified time period has transpired, device 10 is reset by moving all slide members 50 to the right hand side of board 20.

It is recognized that although the present invention has been described in conjunction with the management of a diet or in the alternative, a drug regime, the present invention can be used to manage other activities. Those activities include, but are not limited to, chores to be accomplished by members of a household and an exercise routine. It is further recognized that the management of all such activities are within the spirit and scope of the present invention.

Device 10, including board 20 and slide members 50, is preferably made of a plastic material and manufactured using a single injection molding process and sold as a kit including legend 80 or 110 and magnets 42.

It will be apparent to those skilled in the art that many modifications and substitutions can be made to the preferred embodiment just described without departing from the spirit and scope of the invention as defined in the appended claims.

What is claimed is:

1. A kit for managing a diet, said kit comprising:

an injection molded board having a front face and a rear face, said board formed with a plurality of horizontal cut-out portions, said cut-out portions defining a plurality of horizontal guide rails therebetween, each said guide rail of said plurality of guide rails is formed with an upper lip and a lower lip, said upper lip and said lower lip extending from said front face of said board a preselected distance toward said rear face of said board;

a plurality of injection molded slide members, said slide members dimensioned to be received by said guide rails, each rail of said plurality of rails receiving a preselected number of said slide members, said upper lip and said lower lip of each guide rail of said plurality guide rails being dimensioned to receive said slide members; and a legend secured to said front face of said board, said legend identifying the plurality of major food groups, said legend positioned adjacent to said plurality of rails so that a correspondence is established between each rail of said plurality of rails and each food group of the plurality of food groups so that sliding a slide member of said plurality of slide members from one end of a rail of said plurality of rails to the other end indicates consumption of a food.

2. The kit as recited in claim 1, wherein said slide members are C-shaped.

3. The kit as recited in claim 2, wherein said legend further identifies examples of foods from each food group of the plurality of major food groups, each example of food of said examples of foods having a serving suggestion.

4. The kit as recited in claim 1, wherein said legend further identifies examples of foods from each food group of the plurality of major food groups, each example of food of said examples of foods having a serving suggestion.

5. The kit as recited in claim 1, further comprising a series of magnets, said series of magnets extending from said rear face of said board.

6. The kit as recited in claim 1, wherein said plurality of slide members is forty slide members.

7. The kit as recited in claim 1, wherein said board and said slide members are made of plastic.

8. The kit as recited in claim 1, wherein said plurality of guide rails is six guide rails.

9. A kit for managing a diet, said kit comprising:

an injection molded board having a front face and a rear face, said board formed with a horizontal cut-out portions, said cut-out portions defining a plurality of horizontal guide rails therebetween, each guide rail of said plurality of guide rails is formed with an upper lip and a lower lip, said upper lip and said lower lip extending from said front face of said board a preselected distance toward said rear face of said board;

a plurality of injection molded slide members, said slide members dimensioned to be received by said guide rails, each rail of said plurality of rails receiving a preselected number of slides, said slide members being C-shaped said upper lip and said lower lip of each guide rail of said plurality of guide rails being dimensioned to receive said slide members;

a legend secured to said front face of said board, said legend identifying the plurality of major food groups, said legend positioned adjacent to said plurality of guide rails so that a correspondence is established between said plurality of rails and the major food groups so that sliding a slide member of said plurality of slide members from one end of a rail of said plurality of rails to the other end indicates consumption of a food; and a series of magnets, said series of magnets extending from said rear face of said board.

10. The kit as recited in claim 9, wherein said legend further identifies examples of foods from each food group of the plurality of major food groups, each example of food of said examples of foods having a serving suggestion.

11. The kit as recited in claim 10, wherein said plurality of guide rails are six horizontal guide rails.

12. The kit as recited in claim 9, wherein said plurality of guide rails are six horizontal guide rails.

13. The kit as recited in claim 9, wherein said plurality of slide members is forty slide members.

14. The kit as recited in claim 9, wherein said board and said plurality of slide members are made of plastic.

15. A kit for managing the consumption of a series of medicines by an individual, said kit comprising:

an injection molded board having a front face and a rear face, said board formed with a plurality of horizontal cut-out portions, said cut-out portions defining a plurality of horizontal guide rails therebetween, each guide rail of said plurality of guide rails is formed with an upper lip and a lower lip, said upper lip and said lower lip extending rearwardly from said front face of said board a preselected distance toward said rear face of said board;

a plurality of injection molded slide members, said slide members dimensioned to be received by said guide rails, each rail of said plurality of rails receiving a preselected number of slides, said upper lip and said lower lip of each guide rail of said plurality of guide rails being dimensioned to receive said slide members; and a legend secured to said front face of said board, said legend identifying a plurality of medicines consumed by the individual, said legend positioned adjacent to said plurality of guide rails so that a correspondence is established between said plurality of rails and the plurality of medicines so that sliding a slide member of said plurality of slide members from one end of a rail of said plurality of rails to the end other indicates consumption of a medicine.

16. The kit as recited in claim 15, wherein said legend further identifies the dosage and the frequency of administration for each medicine of the plurality of medicines.

17. The kit as recited in claim 16, wherein said slide members are C-shaped.

18. The kit as recited in claim 15, wherein said slide members are C-shaped.

19. The kit as recited in claim 15, wherein said board and said plurality of slide members are made of plastic.

20. The kit as recited in claim 15, further comprising a series of magnets secured to said rear face of said board.

* * * * *